US005269233A

United States Patent [19]

Johnson et al.

[11] Patent Number: 5,269,233

[45] Date of Patent: Dec. 14, 1993

[54] STOKER OR PARTICULATE CONVEYOR

[76] Inventors: Howard A. Johnson, N5621 County E; Lloyd D. Bauer, N5610 Rich Lake Rd., both of Ogdensburg, Wis. 54962

[21] Appl. No.: 957,241

[22] Filed: Oct. 6, 1992

[51] Int. Cl.[5] ..... F23K 3/14

[52] U.S. Cl. ..... 110/110; 74/84 R; 110/101 CF; 110/276; 222/252; 222/412; 198/674; 414/175; 414/190

[58] Field of Search ..... 110/101 R, 101 A, 101 CF, 110/115, 276, 110; 198/674; 222/252, 412, 413; 414/158, 175, 190, 197, 326; 74/84 R

[56] References Cited

U.S. PATENT DOCUMENTS

| | | | |
|---|---|---|---|
| 1,510,045 | 9/1924 | Day | 110/101 R |
| 1,757,401 | 5/1930 | Thomas | 110/101 R X |
| 2,158,223 | 5/1939 | De Mooy | 110/101 A |
| 2,250,181 | 7/1941 | Crocker | 110/45 |
| 2,333,316 | 11/1943 | Klossner | 121/157 |
| 2,600,614 | 6/1952 | Campbell | 110/44 |
| 3,057,215 | 10/1962 | Stewart | 74/84 X |
| 3,545,297 | 12/1970 | Mahn | 74/84 R X |
| 4,191,301 | 3/1980 | Hickman et al. | 74/84 R X |
| 4,574,712 | 3/1986 | David | 110/288 |

*Primary Examiner*—William E. Tapolcai

*Attorney, Agent, or Firm*—Ryan, Kees & Hohenfeldt

[57] ABSTRACT

A heater for burning particulate combustible fuel material, and a stoker for transferring the fuel for use in connection with such a heater. The heater includes a burner with a step upward from the stoker onto the burner, for reducing the possibility of the fire burning back into the supply of fuel. The stoker includes a first conveyor and a second conveyor, spaced vertically apart and connected together by a drop box. A drive arrangement for driving the conveyors includes a prime mover connected to the first conveyor by means of a drive shaft and to the second conveyor by an intermittent drive. The intermittent drive includes a second shaft with a plurality of paddles extending radially outwardly therefrom. In one embodiment, one or more paddles are removably affixed to the first shaft and extend radially outward therefrom. Thus rotation of the first shaft causes rotation of the second shaft only when the paddles are in contact. If there are fewer paddles on the first shaft than on the second, the second shaft will be driven intermittently. In another embodiment, the paddles on the second shaft are replaced with tabs, and the paddles on the first shaft are replaced with pegs. If there are fewer pegs on the first shaft than tabs on the second, the second shaft will be driven intermittently.

32 Claims, 3 Drawing Sheets

STOKER OR PARTICULATE CONVEYOR

BACKGROUND OF THE INVENTION

This invention relates to conveyors for conveying particulate matter, with particular application to conveyors used to stoke furnaces with combustible particulate matter, such as wood chips, sawdust, pelletized fuel and the like Stoker-type furnaces in general are exceedingly old, beginning with some of the earliest coal-fired furnaces. The stoker of such a furnace provides a conveyor for moving the solid fuel, in the form of combustible particulate matter, into the furnace for burning. With the energy shortages of the last few years, though, and the realization of the limitations of fossil fuels, there has been a resurgence of interest in wood-fired furnaces, fueled by wood chips, sawdust, pelletized wood fuel and the like. Even users interested in preservation of fossil fuels, though, are also interested in convenience Therefore the resurgence of interest in wood-fired furnaces brought with it a resurgence of interest in stokers.

For example, automatic coal stokers are shown in Crocker, U.S. Pat. No. 2,250,181, Klossner, U.S. Pat. No. 2,333,316 and Campbell, U.S. Pat. No. 2,600,614. In all three of these patents however, all issued between 1940 and 1953, there is very little provision for preventing or reducing the risk of the fuel burning back into the supply and out of control. The David patent, U.S. Pat. No. 4,574,712, shows a stoker with two augers, one positioned above the other and connected by a drop box. Both of the conveyors are directly driven by the same prime mover, though.

This invention relates to improvements to the apparatus described above and to solutions to some of the problems raised or not solved thereby.

SUMMARY OF THE INVENTION

The invention relates to a heater for burning particulate combustible material, and a stoker for use in connection with such a heater. The heater includes a burner comprising a substantially flat grating. The stoker includes means for conveying the particulate material or fuel from a stored supply of such material or fuel to the burner. The stoker includes a first conveyor and a second conveyor, spaced vertically apart and connected together by a drop box. The first conveyor is for moving the particulate fuel along a first flow path from the supply toward the drop box. The second conveyor is for conveying the fuel along a second flow path from the drop box to the burner. The second conveyor pushes the fuel from the discharge end thereof onto the grating of the burner, the fuel closer to the grating being pushed onto the grating by the fuel that is closer to the conveyor As the fuel burns, it is pushed further along the grating, so that by the time it reaches the end of the grating there is nothing left but ash to be pushed into the ash pit and disposed of by the ash conveyor. The grating is at a level above the lowest point of the second conveyor, and connected to the second conveyor by a step that slopes upward from the second conveyor to the level of the grating. This stepped burner arrangement is provided so as to inhibit the fire from burning the fuel before it is on the burner.

Drive means are provided for driving the conveyors. The drive means include a prime mover, such as an electric motor, connected to the first conveyor by means of a drive shaft and to the second conveyor by intermittent drive means. The prime mover is connected to and drives the first conveyor by means of a drive shaft. In one embodiment the intermittent drive means includes a first shaft connected to the prime mover for rotation thereby A second shaft has a plurality of paddles affixed at substantially a single axial location thereon and extending radially outwardly therefrom One or more paddles are affixed to the first shaft and extend radially outward therefrom. The second shaft is spaced apart from the first shaft by a distance, with the paddles aligned axially, such that the paddles on the first shaft contact the paddles on the second shaft. Thus rotation of the first shaft causes rotation of the second shaft when the paddles are in contact If there are fewer paddles on the first shaft than on the second, the second shaft will be driven intermittently. In one embodiment each of the paddles is removably affixed to a respective disk in turn substantially perpendicularly affixed to the respective shaft, such that the number of paddles affixed to any disk may be easily varied.

In another embodiment, the first shaft has one or more pegs, and the second shaft has a plurality of tabs axially aligned with the one or more pegs of the first shaft, so as to be contacted by the peg or pegs. Again, as with the paddle system referred to above, if there are fewer pegs than tabs, the second shaft is again driven intermittently by the first shaft.

Other objects and advantages of the invention will become apparent hereinafter.

DESCRIPTION OF THE PREFERRED EMBODIMENTS

Figure 1:
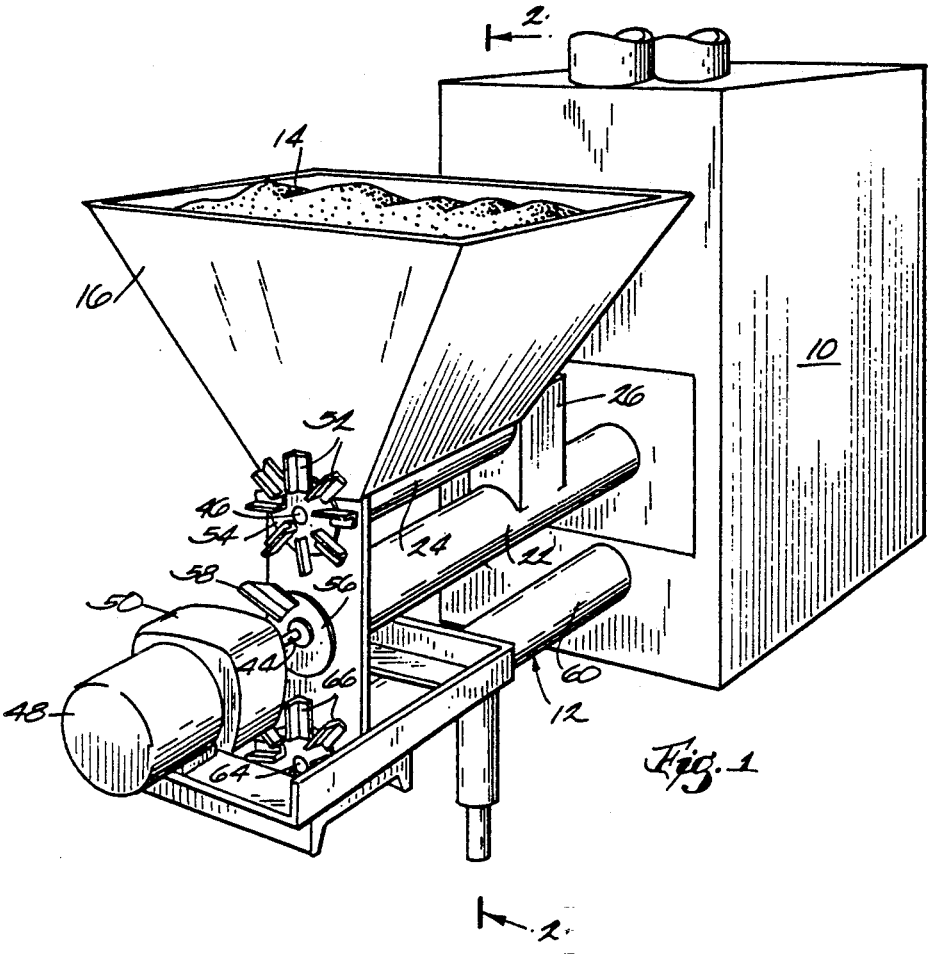
FIG. 1 is a perspective view of a furnace having a stoker constructed according to a preferred embodiment of the invention.
Figure 3:
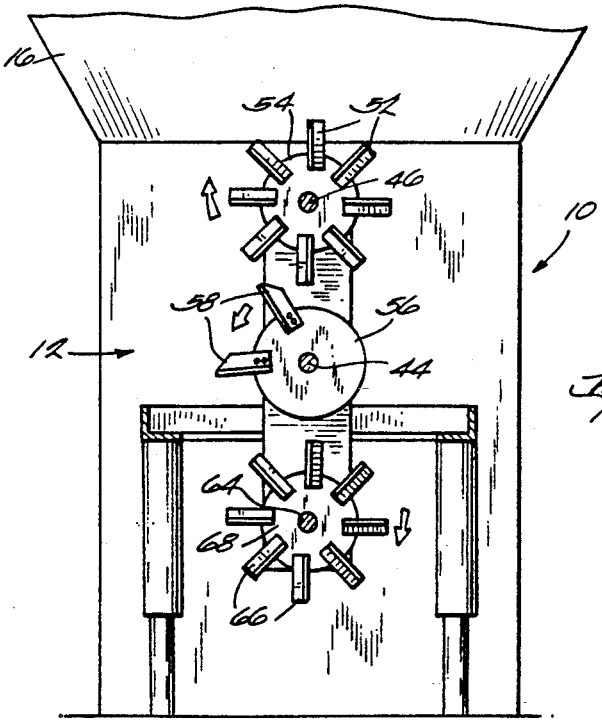
FIG. 3 is a cross-sectional view of the furnace shown in FIG. 2, taken generally along line 3—3 thereof.
Figure 2:
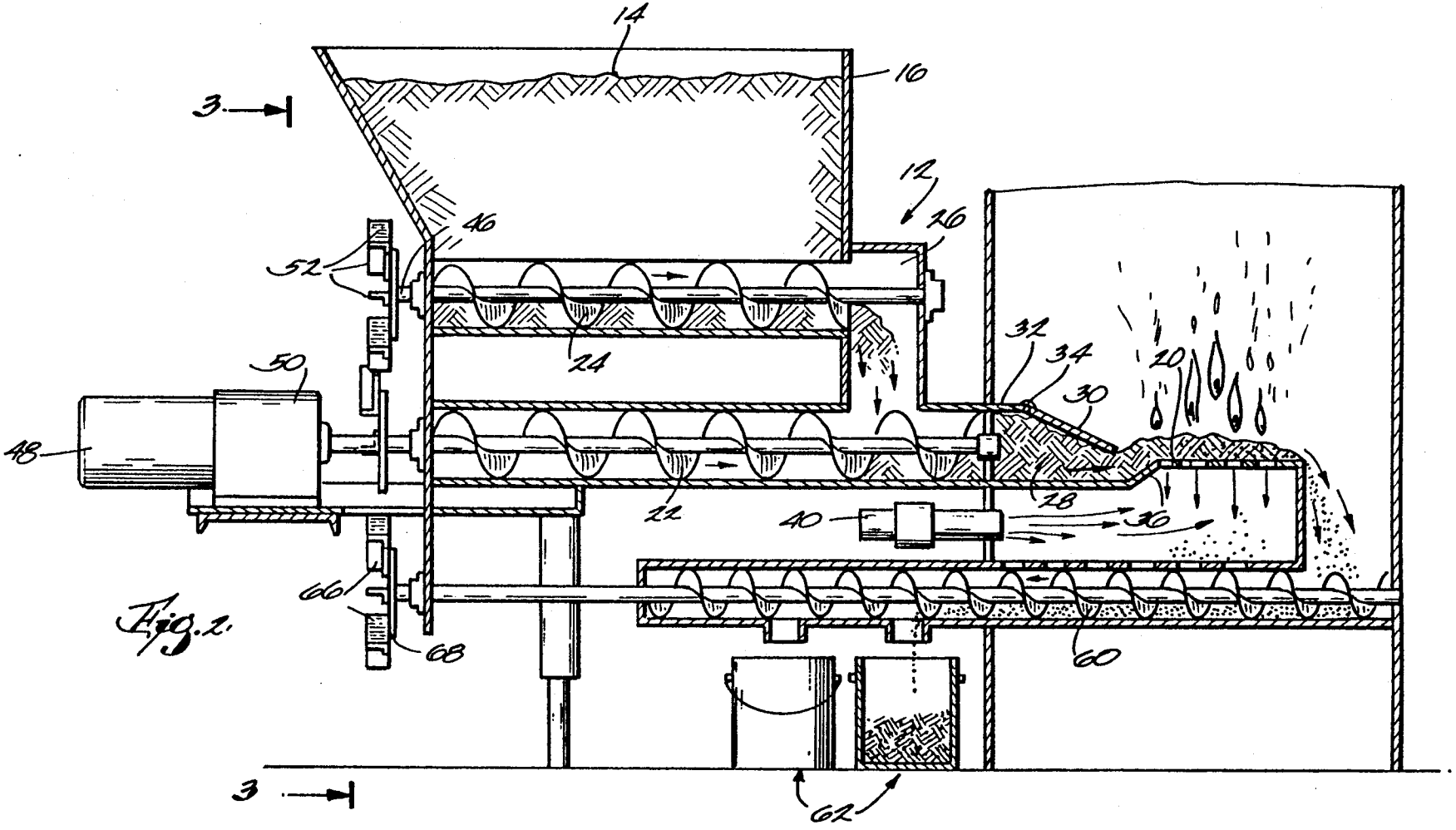
FIG. 2 is a cross-sectional view of the furnace shown in FIG. 1, taken generally along line 2—2 thereof.

Referring now to FIGS. 1 through 3, there is shown a furnace 10 having a stoker apparatus 12 for feeding combustible particulate fuel 14 from a hopper 16 containing a supply thereof In the embodiment shown, the furnace 10 includes a burner 18, onto which the stoker 12 pushes the fuel 14. The burner 18 includes a grating 20. As the fuel burns, a few of the ashes remaining fall through the grating for disposal, while the rest are pushed over the far edge **20*a* of the grating, as will be described subsequently herein In the embodiment shown, the stoker apparatus 12 includes two auger conveyors, a lower conveyor 22 and an upper conveyor 24, although any suitable type of particulate conveyor could be used. Referring now mainly to FIG. 2, it is shown that the upper conveyor 24 has an open top, which communicates with and receives particulate fuel 14 from the open bottom of the fuel hopper 16. The upper conveyor 24 conveys the fuel 14 to a drop box 26, where the fuel is permitted to fall into the lower conveyor 22. In turn, the lower conveyor 22 conveys the fuel 14 toward the burner 18**. Since there is a small space 28 between the end of lower conveyor 22 and the burner 18, a small amount of fuel 14 may build up in that space. As the lower conveyor 22 pushes more fuel 14 into that space 28, the fuel nearest the burner 18 is pushed out onto the burner, spread out by a spring loaded spreader plate 30. This spreader plate 30 is preferably pivotably mounted to the upper edge of the conduit 32 containing lower conveyor 22, and biased downward onto the fuel 14 by suitable means such as a spring 34, causing the fuel to spread over a wider area than the width of the conduit.

As can be seen in FIG. 2, the level of the grating 20 is above the bottom level of the conduit 32 of lower conveyor 22. In this embodiment the grating 20 is connected to the level of the conduit 32 by an upward step 36 in the burner plate. The fuel 14 is thus heated before it reaches the grating 20 simply by its proximity to the fuel already burning, but it is prevented from actually igniting until it clears the step 36 and reaches the same level as the burning fuel. The invention may provide means for forcing air into the combustion chamber 38, or the area above the grating 20, such as a blower 40. This forced air improves combustion on the grating 20.

The invention provides a novel means for driving the conveyors 22, 24. As shown in FIGS. 1 through 3, the conveyors 22, 24 include respective drive shafts 44, 46. A prime mover 48, such as an electric motor, is connected to the drive shaft 44 of the lower conveyor 22. A speed reducer 50, such as a gear reducer or a belt drive arrangement, may be connected between the prime mover 48 and the lower conveyor drive shaft 44 so as to reduce the speed of the drive shaft from the normal speed of a motor.

According to the invention, the driving means includes means for intermittently driving the upper conveyor 24 from the same prime mover used to continuously drive the lower conveyor 22. In this embodiment a plurality of paddles 52 are connected to the drive shaft 46 of the upper conveyor 24. This embodiment includes eight such paddles, but any suitable number may be used. These paddles 52 are preferably evenly spaced about the shaft 46 and project substantially radially outward. The length of the paddles 52 is not so great as to contact the lower conveyor drive shaft 44. The paddles may be attached by any suitable means, such as by molding in one piece attached to shaft 46, or by welding to a disk 54 in turn affixed to the shaft. Lower conveyor drive shaft 44 has affixed thereto a disk 56, substantially axially aligned with the paddles 52 of the shaft 46. This disk 56 includes means for removable attachment of one or more paddles 58. When so attached, the paddles 58 radiate substantially radially outward from the shaft 44, in substantial axial alignment with the paddles 52 of the upper shaft 46. The paddles 58 are sufficiently long that they contact the paddles 52 on the upper shaft 46, but not so long as to contact the upper shaft itself.

If the number of paddles 58 attached to the lower shaft 44 is less than the number of paddles 52 attached to the upper shaft 46, the motion of the upper shaft will be intermittent. Particularly the motion will be intermittent if the paddles 58 are attached unequally about the shaft 44, as shown best in FIG. 3. For example, if the upper shaft 46 has eight paddles 52, the lower shaft lower shaft 44 has two paddles 58, and the lower shaft is driven at 6 revolutions per minute, the upper shaft, intermittently driven, will complete an average of about 1.5 revolutions per minute. This relative speed is easily adjusted by the addition or removal, as desired, of lower paddles 58.

The invention may also provide for an ash disposal conveyor 60, to convey the ashes that fall through the grating 20 and those pushed off the end 20*a* of the grating to a disposal site 62, as shown in FIG. 2. As shown there, the ash conveyor 60 is preferably positioned below the grating 20. The upper surface of the ash conveyor 60 is open to receive the ashes as they fall. The drive means for the ash conveyor 60 may be similar to that for the upper conveyor 24. That is, ash conveyor 60 includes a drive shaft 64. This shaft 64 has attached to it a plurality of paddles 66, which may be attached thereto by suitable means such as being integrally formed and attached, or by welding the paddles to a disk 68 affixed to the shaft. The ash conveyor shaft 64 is positioned below the lower conveyor shaft 44 The paddles 66 are substantially axially aligned, and spaced apart from lower shaft 44 sufficiently, and the length of the ash conveyor paddles 66 are such, that the lower conveyor paddles 58 contact the ash conveyor paddles. Thus, the ash conveyor 60 is also driven intermittently. The speed of the ash conveyor 60 may be the same as that of the upper conveyor 24 if the ash conveyor paddles 66 number the same as the upper conveyor paddles 52. If the number of paddles is different, the speed will be different.

Figure 5:
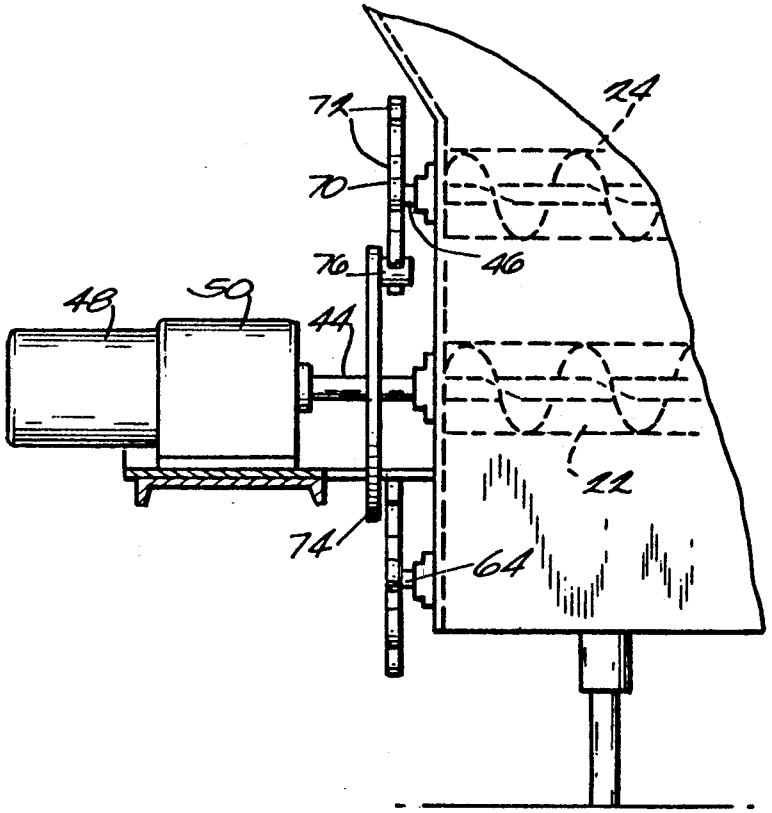
FIG. 5 is a side elevational view of the stoker shown in FIG. 4.
Figure 4:
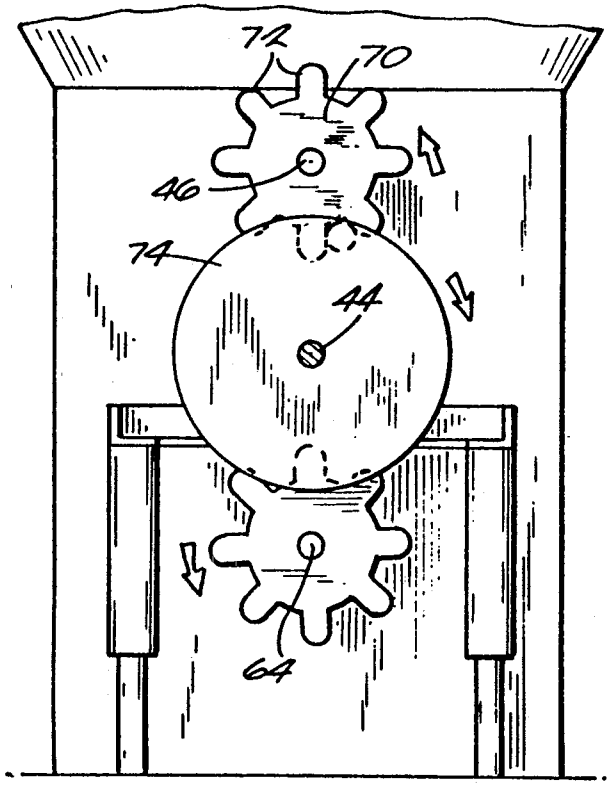
FIG. 4 is a front elevational view of a furnace having a stoker constructed according to an alternative embodiment of the invention.

Another embodiment of the intermittent drive means is shown in FIGS. 4 and 5 As there shown, as an alternative to paddles attached to the drive shaft, a driven plate 70, having integral tabs 72 projecting radially outward therefrom, is affixed to the shaft 46 in order to drive upper conveyor 24. Preferably tabs 72 are disposed relatively evenly about the periphery of plate 70. A drive plate 74 is affixed to the drive shaft 44. The drive plate 74 includes means for removably attaching one or more cleats or pegs 76 projecting axially of the plate, near the periphery thereof. Plates 70 and 74, tabs 72 and peg 76 are positioned so that each peg engages with the tabs once per revolution of the plate 74, resulting in the desired intermittent rotation of driven shaft 46 from drive shaft 44. If more rotation of the driven shaft 46 is desired, additional pegs 76 may be attached at different points about the periphery of the plate 74.

Similarly, in this embodiment the ash conveyor 60 is provided with another plate 78 similar to plate 70, and also having tabs 80, similar to tabs 72 on plate 70. Intermittent driving of the ash conveyor is thus accomplished by the same means.

While the apparatus hereinbefore described is effectively adapted to fulfill the aforesaid objects, it is to be understood that the invention is not intended to be limited to the specific preferred embodiment of stoker or particulate conveyor set forth above. Rather, it is to be taken as including all reasonable equivalents within the scope of the following claims.

We claim:

1. A heater for burning particulate combustible material, comprising:

a burner comprising a grating;

conveyor means for conveying said particulate material from a stored supply of such material to said burner, said conveyor means including a first conveyor and a second conveyor, spaced vertically apart and connected together by a drop box, said first conveyor for moving said particulate material along a first flow path from the supply toward the drop box and said second conveyor for conveying said particulate material along a second flow path from said drop box to said burner, said second conveyor pushing said particulate matter onto said grating;

said grating being at a level above the lowest point of said second conveyor, and connected to said second conveyor by a step that slopes upward from the second conveyor to the level of said grating; and drive means for driving said first and second conveyors including a prime mover, connected to said second conveyor by means of a drive shaft and to said first conveyor by intermittent drive means.

2. A heater for burning particulate combustible material, comprising:

a burner comprising a grating;

conveyor means for conveying said particulate material from a stored supply of such material to said burner, said conveyor means including a first conveyor and a second conveyor, spaced vertically apart and connected together by a drop box, said first conveyor for moving said particulate material along a first flow path from the supply toward the drop box and said second conveyor for conveying said particulate material along a second flow path from said drop box to said burner, said second conveyor pushing said particulate matter onto said grating;

said grating being at a level above the lowest point of said second conveyor, and connected to said second conveyor by a step that slopes upward from the second conveyor to the level of said grating; and drive means for driving said second conveyor, and for intermittently driving said first conveyor.

3. A heater as recited in claim 2 wherein said drive means includes a primer mover connected to said second conveyor by means of a drive shaft; and means for intermittently driving said first conveyor from said drive shaft.

4. A heater as recited in claim 3 wherein said intermittently driving means includes:

a first shaft connected to said first conveyor and having affixed at substantially a single location thereon and extending radially outwardly therefrom a plurality of paddles; and one or ore paddles connected to said drive shaft and extending radially outward therefrom, said first shaft spaced apart from said drive shaft by a distance such that said paddles on said drive shaft contact said paddles on said first shaft, rotation of said drive shaft thereby causing rotation of said first shaft when said paddles are in contact.

5. A heater as recited in claim 4 wherein said paddles are affixed to a disk in turn affixed to the respective shaft.

6. A heater as recited in claim 4 wherein each of said paddles is removably affixed to a respective disk in turn affixed to the respective shaft, such that the number of paddles affixed to any disk may be varied.

7. A heater as recited in claim 3 wherein said intermittently driving means includes:

a first shaft having connected thereto and extending radially outwardly therefrom a plurality of tabs; and one or more pegs connected said drive shaft, said first shaft spaced apart from said drive shaft by a distance such that said pegs contact said tabs, rotation of said drive shaft thereby causing rotation of said first shaft when said pegs are in contact with said tabs.

8. A heater as recited in claim 7 wherein each of said pegs is removably affixed to a plate in turn affixed to said drive shaft, such that the number of pegs affixed may be varied.

9. A heater for burning particulate combustible material, comprising:

a burner;

conveyor means for conveying said particulate material from a stored supply of such material to said burner, said conveyor means including a first conveyor and a second conveyor spaced vertically apart and connected together by a drop box, said first conveyor for moving said particulate material along a first flow path from said drop box to said burner and said second conveyor for conveying said particulate material along a second flow path from the supply to the drop box; and means for driving said first and second conveyors including a prime mover, connected to said first conveyor by means of a drive shaft and to said second conveyor by intermittent drive means.

10. A heater as recited in claim 9 wherein said intermittent drive means includes:

means for connecting said drive shaft to said prime mover for rotation thereby;

a second shaft having a plurality of paddles affixed at substantially a single location thereon and extending radially outwardly therefrom; and one or more paddles connected to said drive shaft and extending radially outward therefrom, said second shaft spaced apart from said drive shaft by a distance such that said paddles on said drive shaft contact said paddles on said second shaft, rotation of said drive shaft thereby causing rotation of said second shaft when said paddles are in contact.

11. A heater as recited in claim 10 wherein said paddles are affixed to a disk in turn affixed to the respective shaft.

12. A heater as recited in claim 10 wherein one or more of said paddles is removably affixed to a respective disk in turn affixed to the respective shaft, such that the number of paddles affixed to the disks may be varied.

13. A heater as recited in claim 9 wherein said intermittent drive means includes:

a driven shaft having affixed thereto and extending radially outwardly therefrom a plurality of tabs; and one or more pegs connected to said drive shaft, said driven shaft spaced apart from said drive shaft by a distance such that said pegs contact said tabs, rotation of said drive shaft thereby causing rotation of said driven shaft when said pegs are in contact with said tabs.

14. A heater as recited in claim 13 wherein each of said pegs is removably affixed to a plate in turn affixed to said drive shaft, such that the number of pegs affixed may be varied.

15. A heater for burning particulate combustible material, comprising:

a burner;

conveyor means for conveying said particulate material from a stored supply of such material to said burner, said conveyor means including a first conveyor and a second conveyor spaced vertically apart and connected together by a drop box;

means for driving said first conveyor including a prime mover connected to said first conveyor by means of a drive shaft; and means for intermittently driving said second conveyor from said drive shaft.

16. A heater as recited in claim 15 wherein said intermittently driving means includes:

a driven shaft having affixed at substantially a single location thereon and extending radially outwardly therefrom a plurality of paddles; and one or more paddles connected to said drive shaft and extending radially outward therefrom, said driven shaft spaced apart from said drive shaft by a distance such that said paddles on said drive shaft contact said paddles on said driven shaft, rotation of said drive shaft thereby causing rotation of said driven shaft when said paddles are in contact.

17. A heater as recited in claim 16 wherein said paddles are affixed to a disk in turn affixed to the respective shaft.

18. A heater as recited in claim 16 wherein each of said paddles is removably affixed to a respective disk in turn affixed to the respective shaft, such that the number of paddles affixed to any disk may be varied.

19. A heater as recited in claim 15 wherein said intermittently driving means includes:

a driven shaft having affixed thereto and extending radially outwardly therefrom a plurality of tabs; and one or more pegs connected to said drive shaft, said driven shaft spaced apart from said drive shaft by a distance such that said pegs contact said tabs, rotation of said drive shaft thereby causing rotation of said driven shaft when said pegs are in contact with said tabs.

20. A heater as recited in claim 19 wherein each of said pegs is removably affixed to a plate in turn affixed to said drive shaft, such that the number of pegs affixed may be varied.

21. Means for conveying particulate matter from a stored supply of such material to a delivery site, comprising:

a first conveyor and a second conveyor spaced vertically apart and connected together by a drop box, said first conveyor for moving said particulate material along a first flow path from said drop box to said delivery site and said second conveyor for conveying said particulate material along a second flow path from said supply to said drop box;

means for driving said first conveyor including a prime mover connected to said first conveyor by means of a drive shaft; and means for intermittently driving said second conveyor from said drive shaft.

22. A conveying means as recited in claim 21 wherein said intermittently driving means includes:

a driven shaft having affixed at substantially a single location thereon and extending radially outwardly therefrom a plurality of paddles; and one or more paddles connected to said drive shaft and extending radially outward therefrom, said driven shaft spaced apart from said drive shaft by a distance such that said paddles on said drive shaft contact said paddles on said driven shaft, rotation of said drive shaft thereby causing rotation of said driven shaft when said paddles are in contact.

23. A conveying means as recited in claim 22 wherein said paddles are affixed to a disk in turn affixed to the respective shaft.

24. A conveying means as recited in claim 22 wherein each of said paddles is removably affixed to a respective disk in turn affixed to the respective shaft, such that the number of paddles affixed to any disk may be varied.

25. A conveying means as recited in claim 21 wherein said intermittently driving means includes:

a driven shaft having affixed thereto and extending radially outwardly therefrom a plurality of tabs; and one or more pegs connected to said drive shaft, said driven shaft spaced apart from said drive shaft by a distance such that said pegs contact said tabs, rotation of said drive shaft thereby causing rotation of said driven shaft when said pegs are in contact with said tabs.

26. A conveying means as recited in claim 25 wherein each of said pegs is removably affixed to a plate in turn affixed to said drive shaft, such that the number of pegs affixed may be varied.

27. A stoker for transferring fuel in the form of particulate matter from a stored fuel supply to a burner, comprising:

a first conveyor and a second conveyor spaced vertically apart and connected together by a drop box, said first conveyor for moving said particulate fuel along a first flow path from said drop box to said burner and said second conveyor for conveying said particulate fuel along a second flow path from said supply to said drop box;

means for driving said first conveyor including a prime mover connected to said first conveyor by means of a drive shaft; and means for intermittently driving said second conveyor from said drive shaft.

28. A stoker as recited in claim 27 wherein said intermittently driving means includes:

a driven shaft having mounted thereon a plurality of paddles; and one or more paddles affixed to said drive shaft, said second driven spaced apart from said drive shaft by a distance such that said paddles on said drive shaft contact said paddles on said driven shaft, rotation of said drive shaft thereby causing rotation of said driven shaft when said paddles are in contact.

29. A stoker as recited in claim 28 wherein said paddles are affixed to a disk in turn affixed to the respective shaft.

30. A stoker as recited in claim 28 wherein at least one of said paddles is removably affixed to a respective disk in turn affixed to the respective shaft, such that the number of paddles affixed to any disk may be varied.

31. A stoker as recited in claim 27 wherein said intermittently driving means includes:

a driven shaft having mounted thereon a plurality of tabs; and one or more pegs connected to said drive shaft, said driven shaft spaced apart from said drive shaft by a distance such that said pegs contact said tabs, rotation of said drive shaft thereby causing rotation of said driven shaft when said pegs are in contact with said tabs.

32. A stoker as recited in claim 31 wherein at least one of said pegs is removably affixed to a plate in turn affixed to said drive shaft, such that the number of pegs affixed may be varied.

* * * * *